United States Patent [19]

Hellner et al.

[11] Patent Number: 4,592,283

[45] Date of Patent: Jun. 3, 1986

[54] EXPLOSIVE SHELL CASE

[75] Inventors: Lars Hellner; Ingemar Haglund; Torsten Rönn; Kjell Albrektsson, all of Karlskoga, Sweden

[73] Assignee: Aktiebolaget Bofors, Sweden

[21] Appl. No.: 714,284

[22] Filed: Mar. 21, 1985

[30] Foreign Application Priority Data

Apr. 2, 1984 [SE] Sweden ..... 8401791

[51] Int. Cl.[4] ..... F42B 13/18

[52] U.S. Cl. ..... 102/493; 102/495; 102/496; 102/497; 102/506

[58] Field of Search ..... 102/495, 496, 506

[56] References Cited

U.S. PATENT DOCUMENTS

| | | | |
|---|---|---|---|
| 3,720,168 | 3/1973 | Sylwester | 102/494 X |
| 3,799,054 | 3/1974 | LaRocca | 102/491 |
| 3,820,464 | 6/1974 | Dixon | 102/495 X |
| 4,165,692 | 8/1979 | Dufort | 102/506 |
| 4,305,333 | 12/1981 | Altenau et al. | 102/493 X |
| 4,312,274 | 1/1982 | Zernow | 102/493 X |
| 4,351,240 | 9/1982 | McCubbin et al. | 102/493 X |

FOREIGN PATENT DOCUMENTS

| | | | |
|---|---|---|---|
| 2923901 | 7/1981 | Fed. Rep. of Germany . | |
| 372983 | 4/1907 | France | 102/494 |
| 2052694 | 6/1979 | United Kingdom . | |

*Primary Examiner*—Peter A. Nelson

*Attorney, Agent, or Firm*—Pollock, Vande Sande & Priddy

[57] ABSTRACT

An explosive shell case of the kind in which fragments are produced by bursting of the case material into a number of small particles. The case material comprises a completely dense, non-compressible material which is made with embrittling zones (4) which when the shell bursts gives fragments of a predetermined shape. The case is preferably manufactured powder-metallurgically, the embrittling zones then being formed by filling at predetermined intervals with powder with the embrittling component. The case is then pressed under high all-round pressure and high temperature into a dense, compact jacket and is imparted its final properties through heat treatment.

10 Claims, 2 Drawing Figures

EXPLOSIVE SHELL CASE

The present invention relates to an explosive shell case of the kind in which framentation is accomplished by bursting of the case into a number of small particles. The invention also relates to a method of manufacturing such a shell case.

BACKGROUND OF THE INVENTION

There are already known designs of an explosive shell case with pre-shaped fragments, preferably in the form of balls of metal with high density, which are baked into a material surrounding the fragments which together with the fragments forms a connected jacket which surrounds the explosives of the shell. A case of this kind gives rise upon detonation of the explosive shell to fragments with small variation in weight and size. As a rule, use is made of balls of heavy metal consisting of 90–95 percent tungsten.

Explosive shell cases with pre-shaped fragments of heavy metal are, however, expensive, partly as a consequence of the content of heavy metal and partly as a consequence of the fact that the case is complicated to manufacture. Since the case must be able to absorb high pressures from the propellant charge and high centrifigal forces from the rotation of the shell, i.e. both axial and radial forces, exacting demands are imposed on its strength. At the same time, the case must also be so designed that the fragmentation effect of the shell becomes as effective as possible, in other words so that the fragments are accelerated to a high and uniform velocity.

Also already known is a method of manufacturing explosive shells in which the fragments are formed by bursting of the steel case of the shell. Explosive shells built up in this manner are, indeed, inexpensive and the fragmentation size is controllable to some extent by selection of material and heat treatment. It is nevertheless unavoidable that such explosive shells give rise to fragments of varying form, weight and size.

SUMMARY OF THE INVENTION

An object of the present invention is therefore to provide a shell case which is comparatively simple to manufacture but which nevertheless has good strength properties and gives a desired, narrower variation in size of fragments than previously known cases without pre-shaped fragments. The invention is characterized to this end largely in that the case material consists of a completely dense, non-compressible material which is made with embrittling zones which, when the shell bursts, give fragments of a predetermined shape.

In a favourable embodiment of the invention these embrittling zones divide the shell case axially into a number of rings, whereby long, narrow fragments are avoided.

The method of manufacturing the shell case is characterized largely in that a metal powder is pressed under high all-round pressure and high temperature into a dense, compact jacket, the embrittling zones being achieved by inserting at predetermined intervals an embrittling component into the case.

According to a favourable embodiment this can take place by filling at predetermined intervals with powder provided with an embrittling component.

Alternatively, the embrittling component can be introduced by stacking alternatively pressed rings of normal powder and rings of powder with an embrittling component.

DESCRIPTION OF THE FIGURES

In the following the invention will now be described in detail and with reference to the accompanying drawing which shows an advantageous embodiment of the invention and wherein

FIG. 1 shows a longitudinal section through a shell base body which comprises a case 1 which surrounds a space 2 for the explosive of the shell. The nose portion 3 of the shell contains a fuze or similar device for detonation of the shell.

DESCRIPTION OF THE PREFERRED EMBODIMENT

The shell base body 1 has several functions to fulfil. It must be able to absorb axial forces and to resist the pressure from the propellant charge of the shell. It must also be able to absorb radial and tangential forces caused by the rapid rotation of the shell and to resist the centrifugal forces acting on the case. The shell case shall also anchor and support one or a plurality of driving bands and possible guiding ridges. The shell case should otherwise be as thin and light as possible in order for the ballast to be the smallest possible.

Figure 1:
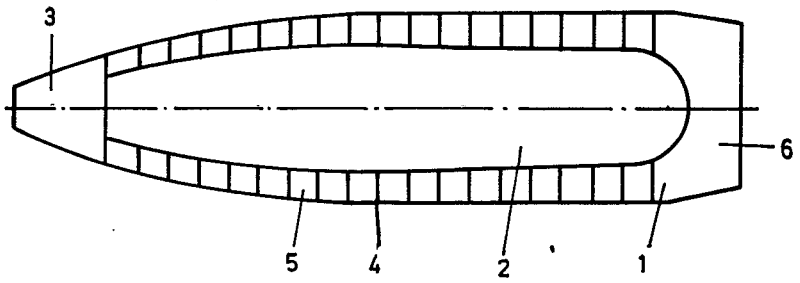
FIG. 1 shows a longitudinal section through a shell body and FIG. 2 shows an enlargement of a portion of the case.

To provide a narrower dispersion of fragments than otherwise, embrittling zones 4 are introduced into the case material which, when the shell bursts, give fragments of a predetermined shape. As evident from FIG. 1, the embrittling zones 4 divide the shell case axially into a number of rings 5, whereby long, narrow fragments are avoided. The division into fragments in the radial direction can naturally be performed in an analogous manner but requires a relatively more complicated manufacturing method. The division into fragments in the radial direction can also more easily be controlled by the properties of the shell material, over and above which the shell case retains its ability to absorb the centrifugal forces to which the rotation give rise.

The explosive shell case according to the invention is appropriately manufactured by a powder metallurgical method. Metal powder for the rearmost portion 6 of the shell, which is subject to the greatest strain upon firing, can be chosen so that it is imparted particularly high strength and good toughness, whereas powder for the rest of the shell is chosen mainly in view of the intended fragmentation effect.

Figure 2:
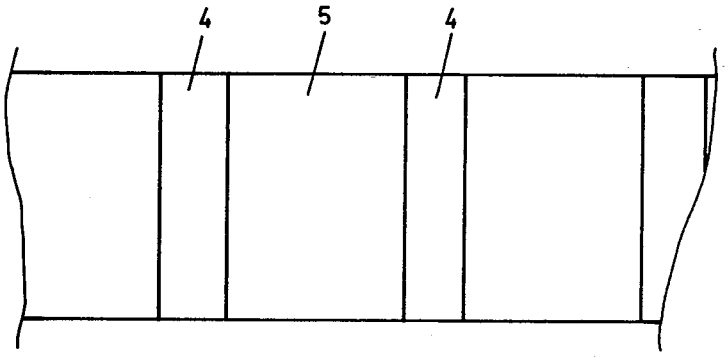

The embrittling component which is mixed into the metal powder may consist for instance of graphite, phosphorus, carbides or oxides. On many occasions, a mixture of a few percent suffices. As evident from FIG. 2, the embrittling zones 4 have an extension in the axial direction which is significantly less than the axial extension of the interlying annular parts 5.

The explosive shell according to the invention can be manufactured in different ways. Characteristics, however, is that a metal powder is used, the embrittling zones are then provided by filling at predetermined intervals with powder containing an embrittling component. The shell case is subsequently pressed under high all-round pressure, for instance above 100 MPa, and high temperature, for instance above 1100° C., into a compact jacket which is then imparted its final properties through a heat treatment, which, in the simplest case, may consist of a controlled cooling or hardening or normalizing from 800–1300° C., preferably 800°–1000° C., and possibly also a tempering at up to 700° C., but preferably at 200°–400° C.

The invention is not restricted to the embodiments described above by way of example but may be varied within the scope of the following claims.

We claim:

1. An explosive shell case of the type in which fragmentation is accomplished by bursting of the shell material into a plurality of small particles, wherein the shell case comprises a plurality of zones consisting of a completely dense, non-compressible material said zones being separated from each other by a plurality of zones of embrittling material whereby upon detonation the shell bursts into fragments of a predetermined shape.

2. A shell case as claimed in claim 1 wherein the embrittline zones divide the shell case axially into a plurality of zones.

3. A shell case as claimed in claim 1 wherein the case material consists of a hardenable steel in which the embrittling zones are formed by admixture therein of an embrittling component.

4. A shell case as claimed in claim 1 wherein the embrittling component consists of at least one member selected from the group consisting of graphite, phosphorus, carbides and oxides.

5. A shell case as claimed in claim 1 wherein the embrittling zones have an extension in the axial direction which is significantly less than the extension in the axial direction of the intermediate sections of the case.

6. A method of manufacturing a shell case as claimed in claim 1, wherein the case is manufactured by forming a powder mass into a shell case by a powder metallurgical procedure comprising the steps of forming a plurality of embrittling zones in said case by introducing at predetermined intervals an embrittling component into the powder mass, thereafter pressing said powder mass under high isostatic pressure and high temperature into a dense, compact case, and subjecting the resulting case shell to heat treatment for imparting its final properties.

7. A method as claimed in claim 6 wherein the embrittling zones are formed by filling, at predetermined intervals with powder containing an embrittling component.

8. A method as claimed in claim 6 wherein the embrittling zones are formed by stacking pressed rings of normal powder alternately with rings of powder containing the embrittling component.

9. A method as claimed in claim 6 wherein the heat treatment comprises controlled cooling, hardening or normalization from about 800°–1300° C. and tempering up to about 700° C.

10. A method as claimed in claim 6 wherein the heat treatment comprises hardening from about 800°–1000° C. and tempering at about 200°–400° C.

* * * * *